United States Patent [19]

Sickles

[11] 4,347,984

[45] Sep. 7, 1982

[54] ELECTROSTATIC SPRAY COATING APPARATUS

[75] Inventor: James E. Sickles, Glenshaw, Pa.

[73] Assignee: PPG Industries, Inc., Pittsburgh, Pa.

[21] Appl. No.: 814,953

[22] Filed: Jul. 12, 1977

Related U.S. Application Data

[63] Continuation of Ser. No. 634,386, Nov. 24, 1975, abandoned, which is a continuation-in-part of Ser. No. 456,944, Apr. 1, 1974, abandoned.

[51] Int. Cl.[3] ..... B05B 5/00

[52] U.S. Cl. ..... 239/707; 239/291; 239/DIG. 19

[58] Field of Search ..... 239/3, 15, 291, 419.5, 239/424, 425.5, 428.5, 602, DIG. 19, 690–708; 118/620, 621, 624, 626–629, 640; 427/13, 26, 27, 30, 31, 45; 361/225–228

[56] References Cited

U.S. PATENT DOCUMENTS

| | | | |
|---|---|---|---|
| 2,491,889 | 12/1949 | Bennett et al. | 361/225 X |
| 2,600,129 | 6/1952 | Richards | 239/15 |
| 3,498,541 | 3/1970 | Taylor, Jr. et al. | 239/15 |
| 3,540,653 | 11/1970 | Fabre | 239/3 X |
| 3,575,344 | 4/1971 | Angelico | 239/3 X |
| 3,613,993 | 10/1971 | Gourdine et al. | 239/3 |
| 3,698,635 | 10/1972 | Sickles | 239/3 |
| 3,746,253 | 7/1973 | Walberg | 239/3 X |
| 3,873,024 | 3/1975 | Probst et al. | 239/15 |

FOREIGN PATENT DOCUMENTS

| | | | |
|---|---|---|---|
| 285773 | 11/1970 | Austria | 239/15 |
| 962590 | 10/1953 | Fed. Rep. of Germany | 239/15 |
| 787845 | 9/1935 | France | 239/15 |
| 1377994 | 12/1974 | United Kingdom | 239/15 |
| 387744 | 10/1973 | U.S.S.R. | 239/15 |

*Primary Examiner*—Andres Kashnikow

*Attorney, Agent, or Firm*—Godfried R. Akorli; George D. Morris

[57] ABSTRACT

An electrostatic spray coating apparatus is disclosed which comprises a spray nozzle containing both air and liquid discharge ports, an inductive charging device or charging electrode located exteriorly of the discharge ports and attached to the spray nozzle, and electrical connections for applying an electric potential to the inductive charging device. The inductive charging device or charging electrode creates a charging zone, and is preferably positioned so that ambient air is mixed with air and fluid exiting from the discharge ports within the charging zone.

25 Claims, 13 Drawing Figures

FIG. 1
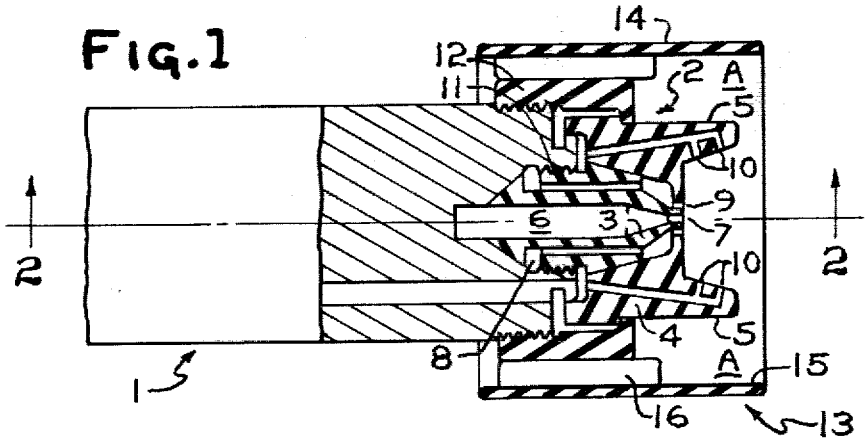
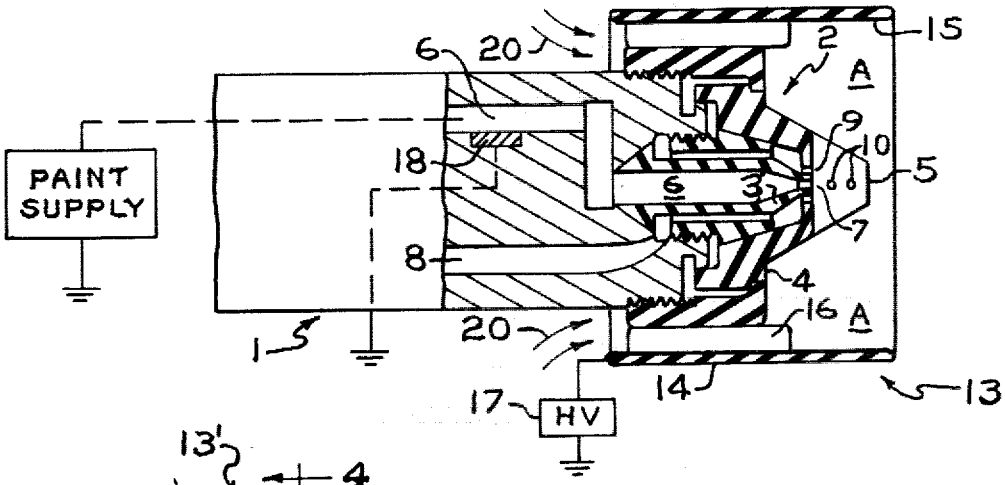
FIG. 2
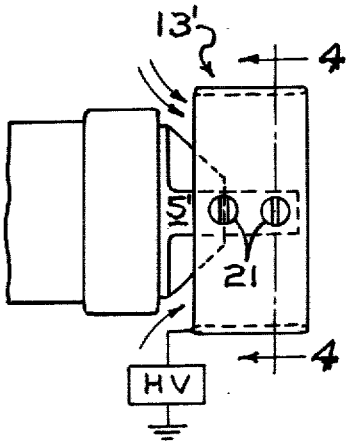
FIG. 3
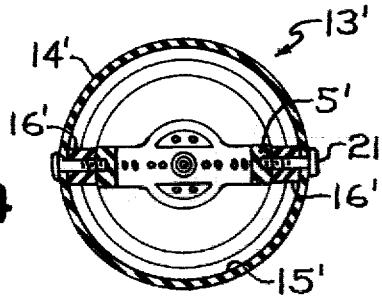
FIG. 4
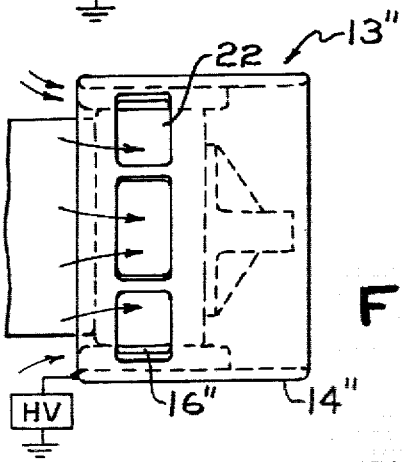
FIG. 5
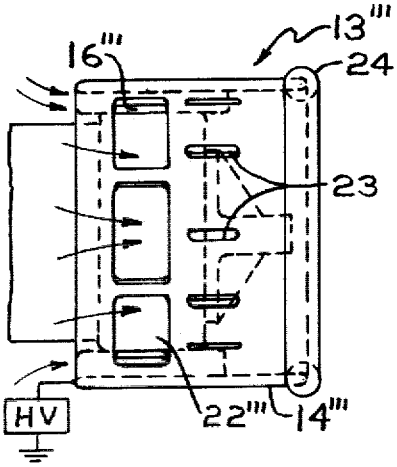
FIG. 6

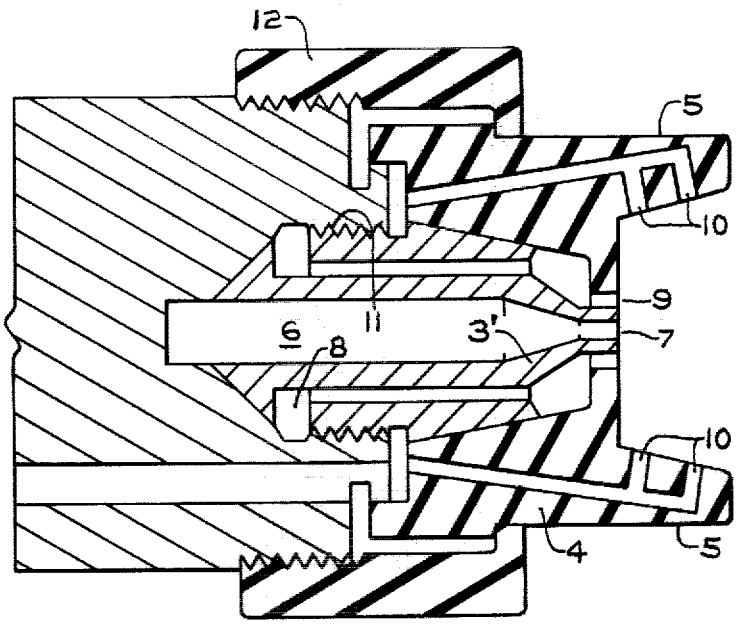
FIG. 12
FIG. 13
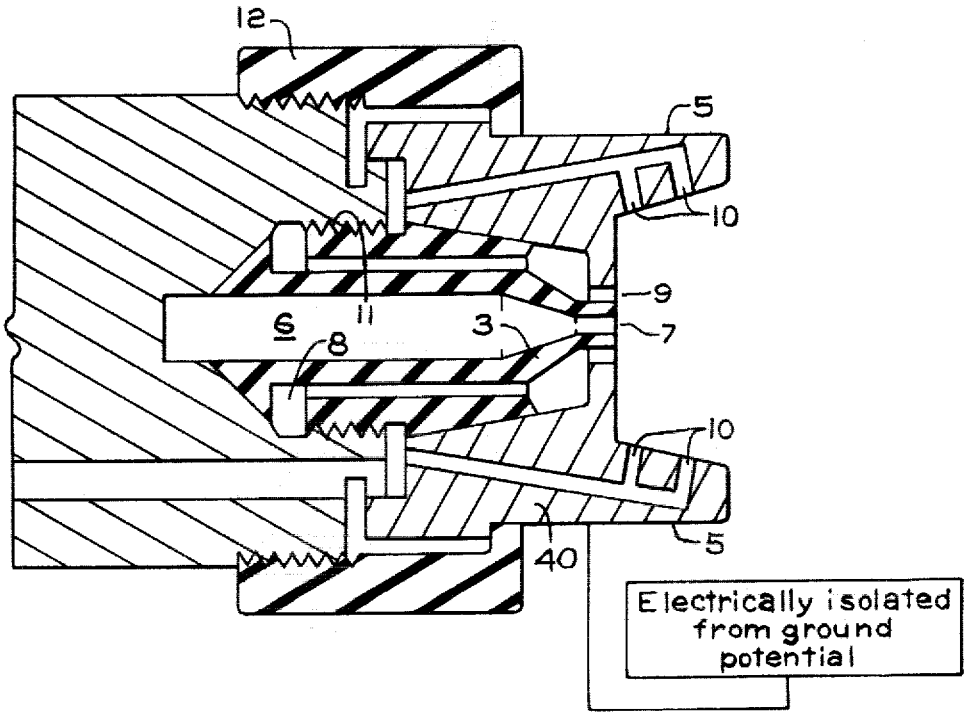

ELECTROSTATIC SPRAY COATING APPARATUS

BACKGROUND OF THE INVENTION

The present application is a continuation of U.S. application Ser. No. 634,386, filed Nov. 24, 1975 now abandoned, which is a continuation-in-part of my prior U.S. application Ser. No. 456,944, filed Apr. 1, 1974 now abandoned entitled "Electrostatic Spray Coating Apparatus".

Many spray coating systems are known which employ electrostatic principles to aid in the deposition of liquid particles upon an article to be coated. These systems differ from each other in several respects, including the means and methods used to atomize and electrostatically charge the liquid. In some systems, at least a part of the coating material is charged within the spray device. In other systems, a charging electrode is located externally of the device with a portion of the device used as ground potential to create a localized field between the device and the electrode.

Many of the known devices utilize relatively high voltages and differ from each other both as to the magnitude of the charge imparted to the liquid particles and to the types of liquids which can be effectively sprayed. Because of the many differences in construction and application of these devices, their use is generally restricted to specific types of liquid and to specific applied voltage ranges.

SUMMARY OF THE INVENTION

It has now been found that an electrostatic spray device of relatively simple construction can be provided which can be used over a wide range of applied voltages and which can be used with a wide variety of different liquids. In addition, the devices hereinafter disclosed can be utilized to simply and economically convert nonelectrostatic spray devices to electrostatic spray devices by attaching an inductive charging means as disclosed herein to such nonelectrostatic spray devices and to convert known high voltage systems to safer low voltage systems which are more economical to operate by merely substituting the inductive charging means disclosed herein for the charging means used in such high voltage systems.

The electrostatic spray device of the instant invention comprises a spray nozzle comprising a fluid nozzle, air cap, and air and liquid discharge port or ports, an inductive charging means or charging electrode located exteriorly of the liquid discharge ports and attached to the spray device, and means for applying an electric potential to the inductive charging means. The spray nozzle itself may be of a conventional construction commonly used in known air atomized spray devices, attached to conventional means for applying pressurized air and liquid to the discharge ports. By "located exteriorly of the liquid discharge ports" is meant that the inductive charging means is adjacent to and/or surrounds and is spaced radially outwardly from the passageways in the spray nozzle through which the liquid passes. In a preferred form of the invention, the inductive charging means is adjacent to and/or surrounds and is spaced radially outwardly from both the liquid and air passageways in the nozzle from which the air and liquid are ejected.

The inductive charging means creates a charging zone, and is preferably positioned so that ambient air is mixed with the pressurized air and liquid exiting from the discharge ports in the spray nozzle. In the presently preferred embodiment, the inductive charging means consists of a cylindrical dielectric tube having a thin conductive film such as metallic film or foil, conductive plastic, or the like, adhered to the inside surface thereof, said tube circumferentially surrounding the discharge ports.

The electric potential applied to the conductive portion of the inductive charging means will generally be less than 20 kilovolts although higher voltages may be used if desired, and depending on the size of the apparatus, the conductivity of the material being sprayed, the materials used for the spray nozzle and inductive charging means, and the like. Thus, the lower the conductivity of the liquid being sprayed, the higher the potential that can be applied to the inductive charging means without producing a corona discharge. However, for optimum results for most liquids useable in this kind of device, it is generally preferred that the average potential gradient within the charging zone be between about 5 and about 20 kilovolts per inch. The optimum average potential gradient will, of course, be dependent upon various factors, including the air pressure, the liquid pressure, the charging electrode size and area, the conductivity of the liquid, the axial location of the charging electrode with respect to the air and liquid discharge ports, and the like. Therefore, in some instances, an increase in the average potential gradient above 20 kilovolts per inch may be required, although it should be recognized that in no event should the voltage be sufficiently high to produce corona discharge.

DESCRIPTION OF THE DRAWINGS

The foregoing objects, features, and advantages of the present invention will become apparent to those of skill in the art from a consideration of the following description of preferred embodiments thereof, taken in conjunction with the accompanying drawings, in which:

FIG. 1 is a partial sectional view of a conventional air-atomized spray device and an inductive charging means located exteriorly thereof according to the instant invention;

FIG. 2 is a sectional view taken along line 2—2 of FIG. 1, further showing the electrical system for the inductive charging means of the instant invention;

FIG. 3 is a side view illustrating another embodiment of the inductive charging means of the instant invention;

FIG. 4 is a sectional view of FIG. 3, taken along line 4—4;

FIGS. 5 and 6 are side elevational views of further embodiments of the inductive charging means of the instant invention;

FIGS. 12 and 13 are partial sectional views of the air-atomizing spray device of FIG. 1, showing various combinations of conductive and non-conductive materials of which the nozzle elements can be made.

DETAILED DESCRIPTION OF THE INVENTION

Figure 7:
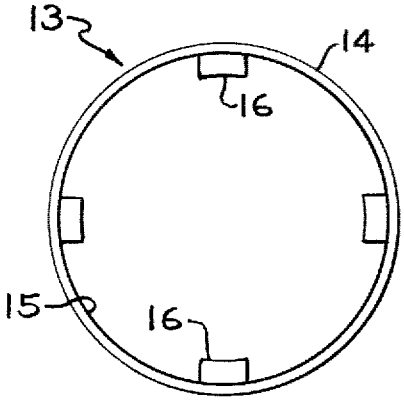
FIG. 7 is an end view of an inductive charging means in accordance with the instant invention, showing means for attaching it to a spray device.

Referring to the drawings, where like numerals represent the same elements in each figure, FIG. 1 illustrates a conventional air-atomized spray device 1, having associated therewith an inductive charging means 13. The spray device is connected to pressurized air and liquid transport means in a known manner. Essentially any electrically conductive liquids (i.e., a liquid having a conductivity greater than 0) may be used, including functional liquids capable of being atomized, such as paint, varnish, lacquer, emulsions, or the like, diluted if necessary with a suitable conductive solvent or mixtures of solvents compatible with the liquid to be sprayed.

At the forward end of the spray device 1 is a nozzle assembly generally indicated at 2, consisting of a liquid nozzle 3 and an air cap 4, the air cap having a pair of oppositely disposed air horns 5. The liquid nozzle 3 is threadedly engaged by means of mating threads 11 with the end of the spray device 1 while air cap 4 engages the outer end of the liquid nozzle and is secured in that position by means of an annular nut 12. The annular nut has an inwardly extending lip which engages a peripheral shoulder on the exterior surface of the air cap and is threadedly engaged to mating threads on the exterior surface of the spray device.

The spray device 1 includes a liquid passageway 6 through which the liquid to be sprayed is conveyed to nozzle assembly 2 where it is discharged through port 7 of the liquid nozzle 3. The discharged liquid is atomized by air delivered by way of passageway 8 in the spray device 1, the air being discharged through air port 9 formed in the air cap 4 and surrounding liquid discharge port 7. If desired, the atomizing air may also be discharged through adjacent ports (note FIGS. 8 through 10) in the face of the air cap. As illustrated in FIGS. 1 and 2, the inwardly directed faces of the air horns 5 have forwardly and inwardly inclined ports 10 for the delivery of spray shaping air jets. While a specific type of nozzle has been shown in these figures, it is to be understood that essentially any air-atomized spray nozzle would be useable in the instant invention, provided that at least the air cap portion is of a dielectric nature; i.e., is either electrically nonconducting, or if conductive is electrically floating, or isolated from ground. Other conventional spray nozzles are disclosed, for example, in U.S. Pat. Nos. 3,169,882; 3,587,967; 3,591,080; 3,692,241; 3,746,253; 3,747,850; 3,764,068; and 3,764,069.

Referring again to FIGS. 1 and 2, the spray device is shown in combination with the inductive charging means, or charging electrode 13, which comprises, in accordance with the preferred embodiment of the instant invention, a cylindrical dielectric tube 14 having laminated or otherwise formed on the inside surface thereof a conductive film 15 to which an electric potential may be applied. The dielectric tube is constructed from essentially any suitable dielectric material, including acetal resins, epoxy resins, and glass filled epoxys or nylon. The conductive film is made from an electrically conductive material such as aluminum, copper, brass, stainless steel, conductive plastics, or the like. The conductive film, which can be in the form of a film or foil, can be laminated to or coated on the tube in any suitable manner, such as, for example, by using an epoxy adhesive, by spray coating, or by vacuum deposition.

The tube 14 is so located with respect to the spray device 1 as to form a charging zone A which surrounds the discharge port 7 of the liquid spray nozzle 3. Conveniently, the tube 14 is attached to the spray device 1 as at nozzle assembly 2 by means of dielectric spacers 16 (See FIG. 7) adhered to or attached (as by the use of dielectric screws) to the inside surface of the tube 14. As shown in FIGS. 1 and 2, the dielectric spacers 16 frictionally engage the outer surface of the retaining ring 12 to lock the tube 14 in place over the nozzle. If desired, the tube 14 can be permanently attached to the spray device.

An electrostatic field is provided within the charging zone A and in the path of the sprayed particles being discharged from the spray nozzle by applying an electric potential from a voltage source or power supply 17, preferably a direct current voltage source, between the conductive film 15 and a ground point. Depending upon the conductivity of the paint, the internal construction of the spray device 1, the length of the hose leading from the liquid supply to the spray device 1, etc., the stream of liquid supplied to passageway 6 is grounded either through a head 18 connected to the stream of liquid in the hollow interior of passageway 6, through the liquid nozzle, if electrically conductive, or through the grounding of the liquid supply source itself, indicated in FIG. 2 as being a supply of paint.

The liquid nozzle 3 may be fabricated of any of the materials from which such nozzles are conventionally constructed, and, in fact, may be any one of the many commercially available nozzles. Although nozzle 3 is illustrated in the drawings as being of a dielectric material, it could be of metal or a combination of materials, but in any case the air cap 4 should be constructed of a dielectric, or electrically nonconductive, material to insure adequate charging efficiency as hereinafter explained. The air cap may be fabricated from any suitable dielectric material capable of withstanding the stresses associated with the highest voltages provided by the power supply which provides the electrical potential to the inductive charging means 13, without an accompanying breakdown or rupture of the material. Suitable materials include acetal resins, epoxy resins, glass filled epoxy resins, glass filled nylon, and the like.

While it is highly desirable that the air cap be fabricated entirely from dielectric materials, since such materials prevent leakage currents to ground, it has been found that it may be made of or have adhered thereto a conductive material as long as such conductive material is not grounded. Accordingly, the air cap 4 may be of metal as long as it is electrically floating or is otherwise isolated from ground. The retaining ring 12 also preferably is of a dielectric material or is isolated from ground, but it may be conductive and electrically grounded under certain circumstances, such as when it is shielded from the electrodes. Thus, if any part of the nozzle assembly 2 is of metal, it should be constructed in such a manner as to minimize leakage currents; that is, the dimensions of the spray apparatus, the location of the electrodes, the electric potentials used, etc., must be such that the accumulation of conductive materials on the various surfaces of the device will not produce substantial current leakage or arcing from the electrodes to other parts of the spray device. For proper operation of the device over a period of time, it is necessary to maintain as long an electrical path as possible between the inductive charging means 13 and any electrically conductive portions of the spray device, consistent with a proper charge induction on the sprayed particles.

As illustrated in FIG. 2, the inductive charging means 13 is preferably attached to the nozzle 2 in such a manner that ambient air, indicated by arrows 20, is mixed within the charging zone A with the air and liquid exiting from the discharge ports 7 and 9. The flow of liquid and air under pressure from ports 7 and 9, together with the flow of air from the spray shaping port 10, creates an aspirating effect within tube 14 which draws the ambient air into the rear of the tube, as indicated in FIG. 2, and this aspirating effect provides for less turbulent air flow around the air cap with the result that there is a lesser tendency for the atomized spray particles to be deposited on the face of the air cap and on the inductive charging means. Additionally, since the ambient air is predominantly drawn from behind the spray nozzle, such air is relatively clean.

In addition to the problem of current leakage and arcing, the material and structural relationships of the nozzle elements and the inductive charging means must be such that corona discharge at the operational voltage level of the device will be prevented. Thus, if the liquid nozzle 3 is of metal, the distance between the nozzle and the closest point on the inductive charging means, principally the distance between the tip of the nozzle and the interior surface of electrode 15 must be great enough to prevent such a discharge since the liquid nozzle will be grounded through the paint supply. Although the system operates effectively when the liquid nozzle 3 is of metal, it has been found that the charging efficiency drops off drastically, in some cases by as much as about 75 percent, when parts near the electrode, such as portions of the air cap 4, are conductive and are electrically grounded. Where the air cap is of a dielectric material, it serves to shield the liquid nozzle 3 and prevents corona discharge, arcing, current leakage, and the like.

If desired, a current limiting resistor (not shown) of suitable ohmic resistance may be coupled to or made a part of the power supply 17. The value selected for the current limiting resistor depends on the magnitude of the voltage appearing at the output terminal of the power supply and generally will be from about 10 to 1000 megohms or more. Power supply 17 may be located within or adjacent to the spray device, or may be carried on the person of the operator of the spray device.

The voltage applied to the charging electrode 13, and more particularly to the conductive film 15, can vary over a wide range, but is preferably less than about 20 kilovolts to prevent corona and surface leakage effects. The voltage applied to achieve optimum charging efficiency will be dependent upon the radial and axial location of the inductive charging means with respect to the axis of the liquid flow. As the inductive charging means is moved radially outward from the axis of the liquid flow; that is, as the diameter of the tube 14 increases with respect to the flow axis of the liquid being discharged from nozzle 3 in the embodiment of FIGS. 1 and 2, higher voltages will be required to achieve optimum charging efficiency. Regardless of the size or shape of the inductive charging means, optimum results are obtained when the average potential gradient within charging zone A is between about 5 and about 25 kilovolts per inch, although higher voltages may be used for particular configurations of the nozzle or electrode or for particular liquid conductivities. However, it is detrimental to the performance of the inductive charging apparatus if the charging electrodes are sufficiently small or sharp and the applied voltages sufficiently high, or if other conditions exist such as high field gradients, that corona discharge effects are induced within the charging zone.

It is apparent that the liquid particles formed upon the discharge of liquid from discharge port 7 are formed in a region of relatively high electric fields. Since the liquids used are conductive, the applied electric field will cause a current to flow in the column of the sprayed liquid to the regions where the particles are formed. A charge, which will be opposite to the polarity of the potential applied to the charging electrode, will then tend to accumulate on the liquid particle surfaces. The liquid particles thereby possess an induced surface charge on the surfaces thereof. In this manner substantially all of the electrically-chargeable particles thus acquire a polarity opposite to the polarity of the potential applied. Since the materials used for the air cap 4 are dielectric, the electric field lines tend to be concentrated on the sharp liquid edges produced in the charging zone during atomization, thereby providing very efficient charging of the liquid particles. If the materials of the air cap 4 are not dielectric, i.e., are conductive, and at ground potential, inefficient charging will result and arcing may become a problem.

The highly charged liquid particles projected by air and liquid pressures from the charging zone A are attracted to target surfaces (not shown) of articles or objects maintained at a particle attracting potential, preferably ground, or earth, potential.

In the embodiment illustrated in FIGS. 1 and 2, the high electrical potential is applied to the inductive charging means 13, while the liquid supply is grounded. In another embodiment of the invention (not shown) the electric potential is applied directly to the liquid supply, and the inductive charging means is kept at ground potential. An electric field is then induced within the above-described charging zone. For optimum results, the above-described average field parameter will apply. This particular embodiment is less desirable, however, since it is not particularly safe to maintain the liquid supply at a high voltage, and because of possible fire hazards due to the high voltage applied to the liquid supply.

In FIGS. 3 and 4, a further embodiment of the inductive charging means of the instant invention is shown. In this embodiment, the inductive charging means 13', having attached or adhered thereto conductive film 15', is secured to the spray device by means of the air horns 5' through the use of screws 21 made of a dielectric material. As shown, the charging means 13' is somewhat shorter in length than that illustrated in the previous embodiment, and is axially located further down stream from the plane of the discharge ports; that is, from a plane perpendicular to the axis of the liquid spray nozzle and extending through the liquid and air discharge ports of the nozzle. Laminated to the inside surface of tube 14' are dielectric spacers 16' into which screws 21 are placed. Again, the inductive charging means 13' is positioned with respect to the discharge ports in such a way that ambient air will be mixed with the pressurized air and liquid within the charging zone, thereby optimizing the atomization and spraying of the liquid.

In a still further embodiment of the invention illustrated in FIG. 5, an inductive charging means 13'', consisting of a dielectric tube 14'' having adhered or attached to the inside surface thereof a conductive film and including dielectric spacers 16'', is provided with openings 22 which serve to further enhance the desired aspirating effect.

Still another embodiment of the invention is illustrated in FIG. 6 wherein an inductive charging means 13''', which consists of a dielectric tube 14''' having adhered or attached to the inside surface thereof a conductive film and dielectric spacers 16''' is provided with openings 22''' and slots 23. The addition of slots 23 further increases the aspirating effect of the inductive charging means 13'' in FIG. 5. The inductive charging means 13''' of FIG. 6 is also provided with a dielectric bead or ring guard 24 around the forward end thereof to protect against possible arcing. This ring guard also reduces the field strength in the area of the end of the tube 14''', which tends to prevent attraction of charged liquid particles on the forward end of the tube.

Figure 8:
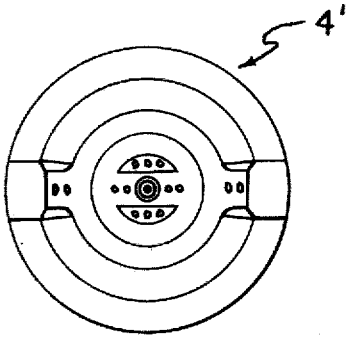
FIGS. 8 through 10 are end views of various types of spray nozzles useable in the instant invention.
Figure 9:
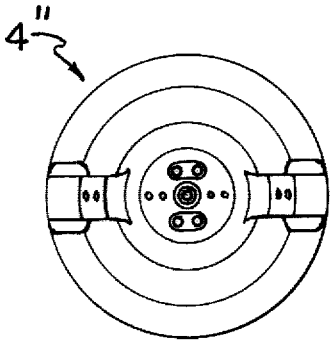
Figure 10:
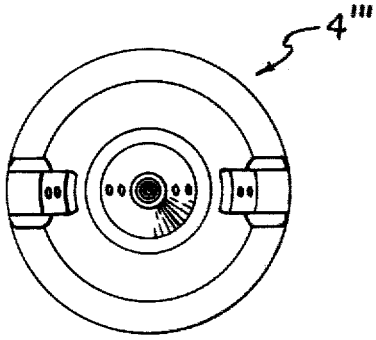

While the inductive charging means disclosed have been shown in use with a specific air cap, it is to be recognized that other air caps of various configurations may also be used therewith. Various other air caps 4' through 4''' are shown in FIGS. 8 through 10. Similarly, while the air caps specifically shown are provided with air horns, it is to be appreciated that the air caps used need not have air horns.

The inductive charging means has been illustrated as being in the shape of a cylindrical tube. It is apparent, however, that the charging means need not have a continuous surface. For example, the charging means could consist of conductive foils or films adhered to the inside surface of the air horns, either directly attached thereto or slightly spaced therefrom. Regardless of the configuration chosen, all corners and edges of the charging means are preferably rounded to avoid corona or possible arcing, and, preferably, the surface area of the charging means is maximized for any given design configuration. The efficiency of any particular configuration will be dependent upon the average potential gradient within the charging zone, with the preferred and optimum gradients being those hereinbefore discussed.

The axial position of the inductive charging means relative to the spray nozzle is not critical. The inductive charging means, however, must be located exteriorly of the discharge ports. As shown in the drawings, the inductive charging means is preferably positioned so that at least a portion of the charging means extends beyond the plane of the air and fluid discharge ports. If desired, however, the entire length of the charging means could extend forward of the plane of the discharge ports. This particular location, however, would not generally be desirable since there would be a greater tendency to accumulate liquid or fluid particles on the charging means. Alternatively, the forward end of the charging means could lie in the plane of the discharge ports. While effective results are also obtainable if the forward end of the charging means is located slightly behind the plane of the discharge ports, such positioning is not desirble since optimum results are generally not obtained.

Similarly, neither the size nor the radial location of the inductive charging means relative to the air and liquid discharge ports are critical. The particular size and radial location will generally be dependent upon the size of the spray device used. For example, the inductive charging means shown in the drawings range in outer diameter from about 1½ inches to over 2½ inches, with lengths ranging from ¾ inch to over 3 inches. However, it is to be recognized that these sizes can be varied over a wide range. In any event, as hereinbefore indicated, as the charging means is moved radially outward from the axis of the liquid flow, higher voltages will be required to optimize the charging efficiency thereof.

The pressure of the air discharging from the air port or ports is not unduly critical and can vary according to the particular degree of atomization and particles size desired. However, for any given fluid flow rate and charging electrode configuration, the total particle current to a grounded target (and thus the charging efficiency) generally increases with increasing atomizing air pressure. Generally, air pressures measured at the air input of the spray device of between about 30 and 70 p.s.i.g. are used. Similarly, the liquid flow rate varies with the degree of atomization and particle size desired and will generally vary between about 100 ml/min. and about 500 ml/min.

Figure 11:
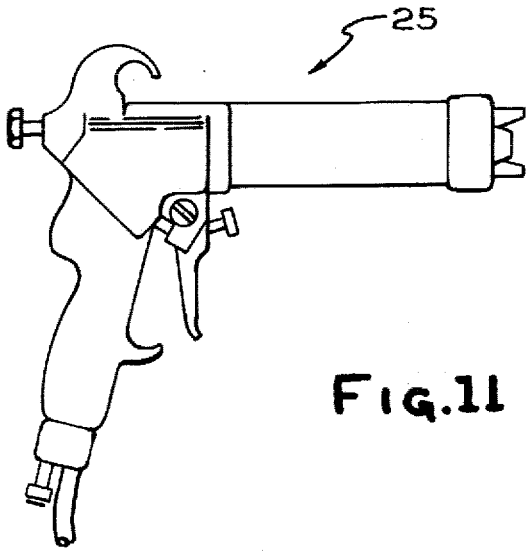
FIG. 11 illustrates a conventional spray gun with which the inductive charging means of the instant invention may be used.

The instant invention can be used with various spray devices. FIG. 11 illustrates a conventional spray gun 25 to which may be attached an inductive charging means according to the instant invention. Alternatively, the inductive charging means of the instant invention could be used as an attachment to an automatic spray device, or a spray device could be constructed utilizing the principles of the instant invention. Similarly, while the inductive charging means has been shown as being removably attached to the spray device, the charging means could be permanently attached thereto.

As mentioned hereinabove, certain of the nozzle elements may be fabricated of both electrically conductive and non-conductive materials in some instances. FIGS. 12 and 13 depict various combinations of conductive and non-conductive nozzle elements, in contrast to the spray nozzle illustrated in FIG. 1 which depicts liquid nozzle 3 and air cap 4 as being fabricated of electrically non-conductive or dielectric materials. In FIG. 12, liquid nozzle 3' is fabricated of electrically conductive material, while air cap 4 is made of a non-conductive dielectric material. In FIG. 13, liquid nozzle 3 is fabricated of an electrically non-conductive material, while air cap 4' is made of an electrically conductive material. It is important that where an air cap is utilized that is made of electrically conductive material or has an electrically conductive material on its exterior surface, the air cap designated element 40 be electrically floating with respect to ground, that is, air cap 40 should be isolated from electrical ground.

Additionally, it is apparent that the instant invention may be utilized to convert non-electrostatic spray devices to electrostatic spray devices by attaching an inductive charging means as disclosed herein to such non-electrostatic spray devices. Alternatively, high voltage electrostatic spray systems may be readily converted to lower voltage systems by merely substituting the charging means disclosed herein for those used with such high voltage systems and reducing the voltage of the power supply.

The invention will further be described in connection with the example which follows. This example is given as illustrative of the invention and is not to be construed as limiting it to the details therein. All parts and percentages in the example are by weight unless otherwise indicated.

EXAMPLE

A spray device made according to the instant invention was utilized to coat two paint solutions on a grounded aluminum substrate. The induction charging means consisted of a 1.625 inch (outer diameter) tube of epoxy. The tube had a wall thickness of 0.0625 inch and was 0.75 inch long. The tube had a 1.5 mil thick aluminum foil adhered to the inside surface thereof. All edges were rounded, and an epoxy bead was applied along the edges of the metal foil. The tube was placed on a conventional nozzle made of a dielectric material such that slightly more than half of of the tube length extended beyond the plane of the discharge ports. The power supply was coupled to the charging means through a 100 megohm resistor. The applied voltage was approximately +8.5 kilovolts with the average potential gradient in the charging zone being about 10 kilovolts per inch. The atomizing air pressure was about 60 p.s.i.g. and the liquid flow rate was about 180 gm./min.

The first paint solution comprised 54.4 parts by weight vehicle solution, 31.9 parts by weight isophorone, and 13.7 parts by weight methanol, with a total solids content of about 23 percent. The paint solution had a conductivity of about 3.6 μmhos/cm. The vehicle solution comprised:

| | Parts by Weight |
|---|---|
| Cellulose acetate butyrate | 20 |
| Acrylic polymer A | 29 |
| Acrylic polymer B | 29 |
| Plasticizer | 22 |

Arcylic polymer A comprised 40 percent solids of polymethyl methacrylate in a solvent mixture of 30 percent toluene and 70 percent acetone. Acrylic polymer B comprised 40 percent solids of methyl methacrylate-butyl acrylate copolymer (82 percent methyl methacrylate and 18 percent butyl acrylate) in a solvent mixture of 30 percent acetone and 70 percent toluene. The plasticizer comprised 85 percent solids in a solvent mixture (37 percent toluene and 63 percent xylene) of 43 parts coconut oil, 6 parts glycerol phthalate, 49 parts ethylene glycolphthalate and 2 parts excess ethylene glycol.

The second paint solution comprised 33.1 percent solids of an acrylic polymer-melamine resin mixture in a solvent mixture. The acrylic polymermelamine resin mixture comprised 79 percent of an acrylic polymer comprising 7.5 parts hydroxypropyl acrylate, 4.8 parts glacial acrylic acid, 13.4 parts methyl methacrylate, 14.6 parts butyl methacrylate, 23.7 parts styrene, and 15 parts butyl acrylate, and 21 percent of melamine-formaldehyde resin (Cymel 303, available from American Cyanamid). The solvent mixture comprises two parts dimethyl ethanolamine, one part acetone, 82 parts deionized water and 15 parts butyl carbitol.

In both instances, uniform paint films were produced with no corona discharge observed, and with little or no particle accumulation on the nozzle and the charging electrode. The current flowing from the substrate to earth ground in both instances was about −12 microamperes.

According to the provisions of the Patent Statutes, there are described above the invention and what are now considered to be its best embodiments. However, within the scope of the appended claims, it is to be understood that the invention can be practiced otherwise than as specifically described.

What is claimed is:

1. An inductive charging electrostatic spray coating apparatus comprising:

an electrically non-conductive spray nozzle including both air and liquid discharge ports arranged in produce air-atomized liquid spray particles;

a substantially cylindrical tube of dielectric material;

means securing said tube exteriorly of said discharge ports and substantially coaxial with the axis of flow of spray particles discharged from said discharge ports;

a charging zone formed between said tube and said spray nozzle discharge ports;

means forming an electrically conductive layer on the interior surface of said tube, at least a portion of said conductive layer passing through a plane perpendicular to the axis of flow of spray particles, said plane passing through at least one of said discharge ports; and means applying an electrical potential between the liquid discharged from said liquid discharge port and said electrically conductive layer to create within said charging zone an electrostatic field having an average potential gradient sufficient to produce induction charging on air-atomized liquid particles as said particles are from said spray nozzle into said charging zone, but insufficient to produce corona effects.

2. The apparatus of claim 1, wherein said means securing said tube includes spacer means for radially spacing said tube from said spray nozzle a distance sufficient to admit a flow of ambient air between said conductive layer and said spray nozzle, said flow of ambient air being aspirated through said tube by the discharge of liquid and air from said discharge ports.

3. The apparatus of claim 2, further including a plurality of openings formed in said tube for admitting ambient air into said charging zone to enhance the aspirated air flow.

4. The apparatus of claim 1, wherein said conductive layer has a continuous surface within said tube.

5. The apparatus of claim 1, wherein said average potential gradient is between about 5 and about 20 kilovolts per inch.

6. The apparatus of claim 1, further including a source of potential, and means for applying said potential to said conductive layer.

7. The apparatus of claim 1, further including a dielectric bead formed on the end of said tube downstream from said spray nozzle discharge ports, said bead covering the downstream edge of said electrically conductive layer to prevent electrical discharge therefrom.

8. A spray apparatus for producing a spray stream of electrically-charged particles by air-atomization of a liquid stream of material in the presence of a static electric field, comprising:

(a) a spray nozzle having a liquid discharge port;

(b) means for forming an atomizing-air discharge port disposed in operable association with said spray nozzle liquid discharge port;

(c) means for conveying liquid material to said liquid discharge port;

(d) means for conveying air to said atomizing-air discharge port for atomizing liquid discharged from said liquid discharge port;

(e) induction charging means including an induction charging electrode operably associated with said spray nozzle;

(f) means for connecting an electrical potential of a first polarity to said induction charging electrode for producing a static electric field having an electric potential gradient;

said induction charging means further characterized by (1) said induction charging electrode having a structural configuration for establishing an electric potential gradient between said induction charging electrode and a liquid stream issuing from said liquid discharge port upon application of said electric potential to said electrode, so that said electrode induces charge of a second polarity which is opposite to said first polarity on substantially all of the electrically-chargeable particles as the particles are formed; and (2) said induction charging electrode is spaced (a) exteriorly of said liquid discharge port and said atomizing-air discharge port; and (b) outwardly of the axis of said liquid discharge port.

9. The apparatus of claim 8, wherein said induction charging means is positioned in relation to said spray nozzle such that ambient air is mixed with a liquid particle spray stream when said spray stream is discharged from said spray nozzle liquid discharge port.

10. The apparatus of claim 9 wherein:

(a) said induction charging electrode is a conductive film;

(b) said apparatus additionally comprises a cylindrical dielectric tube having an inside surface; and (c) said conductive film is adhered to said inside surface of said cylindrical dielectric tube.

11. The apparatus of claim 10, wherein said conductive film is selected from the group consisting of metals and conductive plastics.

12. The apparatus of claim 10, wherein said induction charging means is provided with a dielectric guard around the forward end thereof.

13. The apparatus of claim 10, wherein said induction charging means is provided with slots to enhance the mixing of liquid particles with ambient air.

14. The apparatus of claim 8, wherein the electric potential gradient, when established around said liquid discharge port upon application of an electric potential to said induction charging electrode, has an average value between about 5 and about 20 kilovolts per inch.

15. The apparatus of claim 14, wherein the average potential gradient is between about 8 and about 12 kilovolts per inch.

16. The apparatus of claim 8 wherein said means for forming an atomizing-air discharge port comprises an air cap having an opening which forms an annular-shaped atomizing-air discharge port in operable association with said liquid discharge port, said air cap being electrically isolated.

17. The apparatus of claim 16, wherein said spray nozzle and said air cap are constructed of dielectric materials.

18. The apparatus of claim 16, wherein said spray nozzle is constructed of an electrically conductive material and said air cap is constructed of a dielectric material.

19. The apparatus of claim 16, wherein said air cap is constructed of an electrically conductive material.

20. The apparatus of claim 16, wherein said spray nozzle is of a conductive material and wherein said air cap is of a dielectric material which shields said spray nozzle.

21. The apparatus of claim 8 further comprising means for producing said electrical potential of said first polarity, said means for producing said electrical potential of the first polarity being connected to the induction charging electrode by said means for connecting an electrical potential to said induction charging electrode.

22. An electrostatic induction charging adapter for attachment to a spray apparatus for spraying charged liquid material particles, the spray apparatus comprising a spray nozzle having a liquid discharge port, means for forming an atomizing-air discharge port disposed in operable association with said liquid discharge port, first conveying means for delivering a stream of liquid material to the liquid discharge port, and second conveying means for delivering a stream of air to the atomizing-air discharge port, the spray apparatus in its operating mode being capable of providing an air-atomized spray stream of particles, said adapter comprising:

(a) support means comprised of dielectric material;

(b) mounting means on said support means for detachably mounting said support means to a spray apparatus;

(c) induction charging means including an induction charging electrode attached to said support means;

(d) means for connecting an electric potential of a first polarity to said induction charging means;

said induction charging means further characterized by (1) said induction charging electrode having a structural configuration for establishing an electric potential gradient between said induction charging electrode and a liquid stream issuing from said liquid discharge port upon application of an electric potential to said electrode when said induction charging adapter is operably attached to a spray apparatus capable of producing liquid particles, so that said electrode induces charge of a second polarity which is opposite to said first polarity on substantially all of the electrically-chargeable particles as the particles are formed; and (2) said induction charging electrode is spaced (a) exteriorly of a liquid discharge port and an air-atomizing discharge port of a spray apparatus; and (b) outwardly of the axis of a liquid discharge port, when said adapter is attached to a spray apparatus.

23. The apparatus of claim 22, wherein said support means comprised of dielectric material further comprises a substantially cylindrical tube, and wherein said induction charging electrode secured to said support means comprises a conductive layer on the interior surface of said tube.

24. The apparatus of claim 23, wherein said mounting means for securing said tube in operative connection with a spray nozzle of the liquid particle spray stream discharge apparatus includes spacer means for radially spacing said tube from the spray nozzle a distance sufficient to admit a flow of ambient air between said conductive layer and the spray nozzle, the flow of ambient air being aspirated through said tube by the discharge of the liquid particle spray stream from the spray nozzle.

25. The apparatus of claim 24, wherein said tube further includes a plurality of openings for admitting ambient air into said tube to enhance the said aspirated air flow.

* * * * *